US007886943B1

(12) United States Patent
Denkins et al.

(10) Patent No.: US 7,886,943 B1
(45) Date of Patent: Feb. 15, 2011

(54) DRYWALL JOINT COMPOUND PUMP WORKSTATION

(75) Inventors: Jeffrey L. Denkins, Shawano, WI (US); Steven J. Mondloch, Kaukauna, WI (US)

(73) Assignee: Apla-Tech, Inc., Kaukauna, WI (US)

( * ) Notice: Subject to any disclaimer, the term of this patent is extended or adjusted under 35 U.S.C. 154(b) by 442 days.

(21) Appl. No.: 12/137,661

(22) Filed: Jun. 12, 2008

Related U.S. Application Data

(60) Provisional application No. 60/943,957, filed on Jun. 14, 2007.

(51) Int. Cl.
*B60P 3/22* (2006.01)

(52) U.S. Cl. ..... 222/608; 222/63; 401/48

(58) Field of Classification Search ..... 222/608, 222/1, 609, 610, 611.1, 613, 614, 626, 181.1, 222/185.1, 63; 401/48, 195, 188 R, 16, 137, 401/108, 207

See application file for complete search history.

(56) References Cited

U.S. PATENT DOCUMENTS

| | | | | | |
|---|---|---|---|---|---|
| 2,007,113 | A * | 7/1935 | Staples | 222/56 |
| 2,317,288 | A * | 4/1943 | Mccubbin | 239/150 |
| 3,940,065 | A * | 2/1976 | Ware et al. | 239/146 |
| 5,230,608 | A * | 7/1993 | Januska | 417/44.1 |
| 5,279,700 | A * | 1/1994 | Retti | 156/578 |
| 5,535,926 | A * | 7/1996 | Blitz et al. | 222/334 |
| 5,878,925 | A | 3/1999 | Denkins et al. | |
| 5,924,598 | A * | 7/1999 | Bradshaw | 222/63 |
| 6,070,808 | A * | 6/2000 | Kildow | 239/146 |
| 6,260,743 | B1 * | 7/2001 | Mazzenga | 222/611.2 |
| 6,419,773 | B1 * | 7/2002 | Lauermann | 156/71 |
| 6,428,287 | B1 * | 8/2002 | Denkins et al. | 417/360 |
| 6,793,428 | B2 * | 9/2004 | Lithgow | 401/48 |
| 7,367,515 | B1 * | 5/2008 | Newman | 239/150 |

* cited by examiner

*Primary Examiner*—Lien T Ngo
(74) *Attorney, Agent, or Firm*—Andrus, Sceales, Starke & Sawall, LLP

(57) ABSTRACT

A portable drywall joint compound pump workstation has a joint compound supply reservoir with an open top and closed bottom removably attached to a wheeled framework. The workstation further has a pump assembly including a pump control removably connected to the framework for pumping joint compound from the supply reservoir to a workstation outlet extending from the pump control. The pump assembly includes a high pressure cylinder connected to a valve and quick coupling arrangement which, in turn, is in communication with the supply reservoir through the bottom end thereof. A discharge line extends between the high pressure cylinder and the pump control for feeding joint compound from the supply reservoir to the pump control. A first discharge port is provided on the pump control for continuously feeding a variety of drywall finishing tools. A second discharge port is provided on the pump control for supplying wash down water to clean tools or act as a source of high pressure fluid. A purge line runs between the pump control and the supply reservoir for priming, recirculating and mixing drywall compound in the reservoir.

8 Claims, 1 Drawing Sheet

DRYWALL JOINT COMPOUND PUMP WORKSTATION

CROSS REFERENCE TO RELATED APPLICATION

This application relates to and claims priority from U.S. Provisional Application Ser. No. 60/943,957, filed Jun. 14, 2007.

FIELD OF THE INVENTION

This invention relates generally to a portable drywall joint compound pump workstation that pumps joint compound into drywall finishing tools and facilitates cleanup at drywall construction sites.

BACKGROUND OF THE INVENTION

Drywall has become a dominant material in the construction of building interiors. In particular, building interiors generally have vertical stud walls that support pre-formed drywall panels attached to the stud walls. Joints between the adjacent drywall panels are taped and finished with joint compound before painting or wall papering. Many drywall finishing tools have been developed over the years to facilitate taping and finishing with joint compound.

When working with drywall finishing tools, substantial amounts of time are spent mixing joint compound, filling application tools with joint compound and cleaning the tools. U.S. Pat. No. 5,878,925, entitled "Drywall Joint Compound Pump Workstation", issued Mar. 9, 1999 to the inventors of this application, discloses a drywall joint compound pump workstation that is designed to accommodate these needs, as well as other needs present at drywall construction work sites. The workstation disclosed in the Denkins et al '925 patent effectively mixes and pumps joint compound for drywall finishing tools. The pump workstation has a series of quickly interchangeable attachments and is extremely versatile. It is also designed to facilitate rinsing and cleaning of the workstation and drywall finishing tools at the work site. In its commercial embodiment, the pump workstation includes a rather large supply reservoir having an open top and a closed bottom for mixing and holding a supply of joint compound. A gravity fed pump is attached to the bottom of the supply reservoir. A transport tube is connected to the pump, and an outlet of the transport tube is positioned in the vicinity of the open top of the supply reservoir. The top of the transport tube is preferably provided with a quick-disconnect fitting so that one of several attachments can be attached to the outlet of the transport tube to facilitate the task at hand. For example, a goose neck attachment is attached to the transport tube in order to mix and recirculate joint compound from the supply reservoir through the pump and the transport tube back into the supply reservoir. Various filling adapters are also provided at the top of the transport tube in order to fill various drywall tools. In addition, a threaded nipple attachment is provided along with a water hose to facilitate on site rinsing and cleaning.

While the drywall joint compound pump workstation disclosed in Denkins et al U.S. Pat. No. 5,878,925 has been commercially successful, there remains a need in the art for an improved workstation that has greater versatility and can better accommodate the needs of drywall workers at drywall construction work sites.

SUMMARY OF THE INVENTION

The invention relates to a portable drywall joint compound pump workstation that effectively mixes and pumps joint compound to various tools for drywall finishing applications. The workstation is also designed to facilitate rinsing and cleaning of the workstation and drywall finishing tools at a work site.

In one aspect, the workstation has a joint compound supply reservoir with an open top and a closed bottom removably attached to a wheeled framework. The workstation further has a pump assembly including a pump control removably connected to the framework for pumping joint compound from the supply reservoir to a workstation outlet extending from the pump control. The pump assembly includes a high pressure cylinder connected to a valve and quick coupling arrangement which, in turn, is in communication with the supply reservoir through the bottom end thereof. A discharge line extends between the high pressure cylinder and the pump control for feeding joint compound from the supply reservoir to the pump control. A first discharge port is provided on the pump control for continuously feeding a variety of drywall finishing tools. A second discharge port is provided on the pump control for supplying wash down water to clean tools or act as a source of high pressured fluid. A purge line runs between the pump control and the supply reservoir for priming, recirculating and mixing drywall compound in the reservoir.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
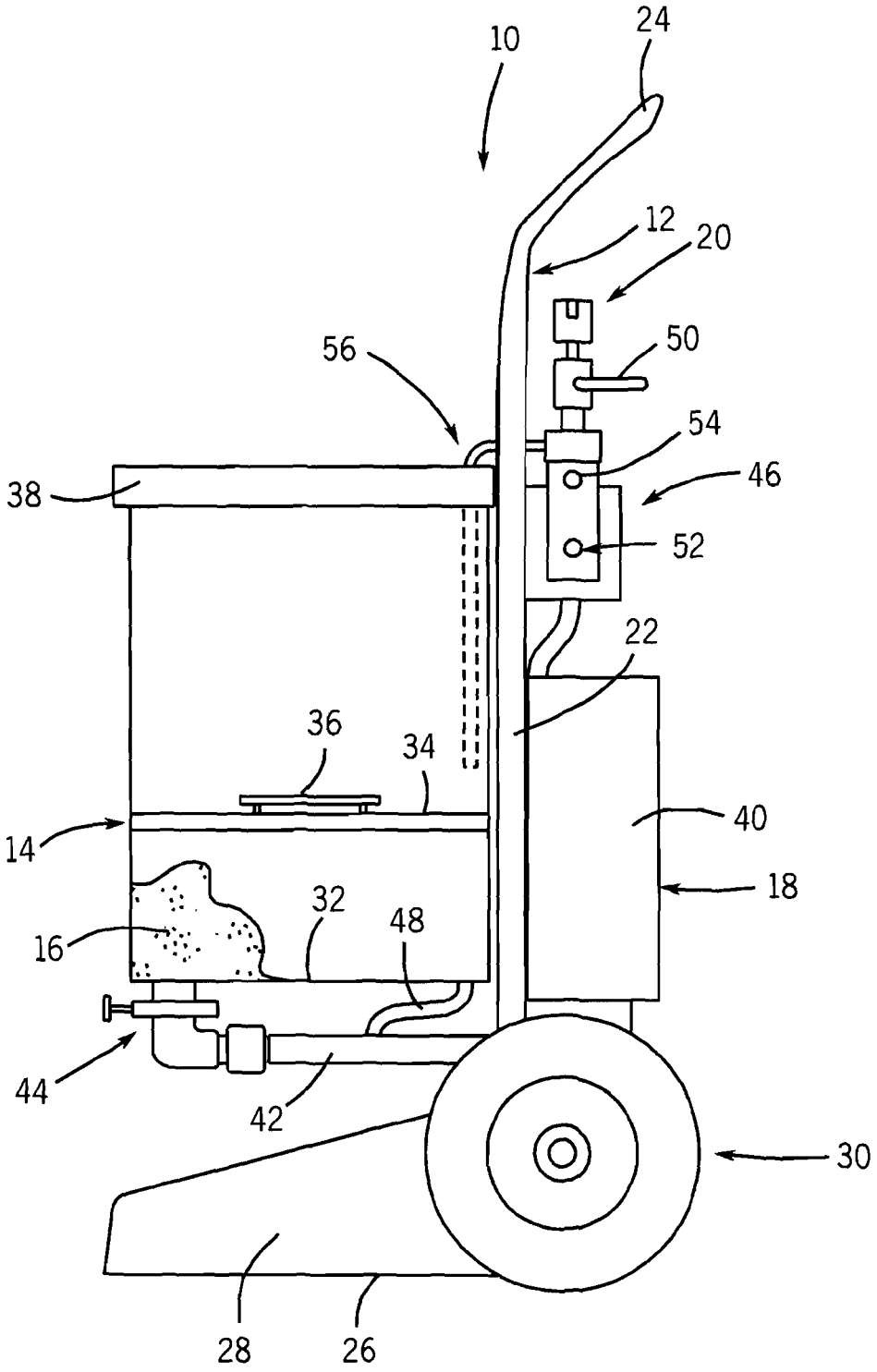
FIG. 1 is a side elevational view of a drywall joint compound pump workstation in accordance with the present invention.

FIG. 1 is a side view of a drywall joint compound pump workstation 10 embodying the present invention. The workstation 10 includes a framework 12 that supports a removable supply reservoir 14 for holding a supply of joint compound 16 (or other particulate matter) and a removable pump assembly 18 for delivering the joint compound 16 to a workstation outlet 20.

The framework 12 is preferably a conventional hand truck having an upright portion 22 with a handle 24, and a lower base plate 26 with reinforcing side plates, one of which is shown at 28. The framework 12 also includes a pair of wheels (one being seen at 30) rotatably mounted thereon for enabling portability of the workstation 10. In normal use, the workstation 10 is supported by the base plate 26 and side plates 28 so that it rests upon a ground surface. Grasping the handle 24 and tilting the framework 12 rearwardly brings each wheel 30 into contact with the ground surface so that the workstation 10 may be easily moved.

The supply reservoir 14 that holds the joint compound 16 is removably connected to the front side of upright portion 22 of framework 12. Joint compound 16 is conventionally formed on site by adding water to a dry mix to obtain a relatively thick liquified, flowable mixture or slurry. The supply reservoir 14 typically is a large capacity (i.e. 10 gallon) cylindrical container that is easily replaced to accommodate whatever size reservoir is desired. The reservoir 14 includes an open top, a closed bottom 32 and a floating lid 34 with a handle 36. The lid 34 is designed to be placed upon the uppermost surface of the joint compound 16 for preventing air pockets from forming in the mixture. A cover 38 closes the open top of the reservoir 14 when desired.

The pump assembly 18 is removably joined to a rear side of upright portion 22 of framework 12. The pump assembly 18 preferably includes a piston pump 40 having a high pressure cylinder 42 which is connected to the bottom end 32 of the reservoir 14 via a valve and quick coupling arrangement 44 that allows for removal of the pump 40 without draining the contents of the reservoir 14. As an example, arrangement 44 may be a gate valve and cam coupling. The cylinder 42 and the arrangement 44 permit communication between the pump 40 and the joint compound 16 in the reservoir 14. The pump assembly 18 further includes a pump control 46 operably coupled to the pump 40 and mounted to the rear side of framework 12 above pump 40. Pump control 46 is connected to cylinder 42 by a discharge line 48 that feeds pumped joint compound 16 to the workstation outlet 20 having an on/off valve 50. The pump valve 46 also includes a first discharge port 52 for continuously feeding a variety of drywall working tools, and a second discharge port 54 for supplying wash down water to clean such tools. Discharge port 54 may be optionally available to use with a high pressure wash down hose or supply the motive power to operate a venturi pump and a low pressure wash down hose. A purge line 56 extends from pump control 46 into the reservoir 14 for the purpose of priming, recirculating and mixing compound 16 therein. A number of accessories may also be provided to facilitate handling of the joint compound 16, and onsite rinsing and cleaning of the workstation 10 and various drywall finishing tools.

In normal operation, the pump 40 is activated to suction joint compound 16 from reservoir 14 and continuously deliver the compound 16 to the outlet 20 or the discharge port 52. Alternatively, the reservoir 14 may be emptied of joint compound 16 and filled with water which can be pumped to outlet 20 or discharge port 54.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. A drywall joint compound pump workstation comprising a wheeled framework;

a joint compound supply reservoir attached to the framework, the supply reservoir having an open top and a closed bottom for mixing and holding a supply of joint compound therein;

a pump assembly including a pump control connected to the framework for pumping joint compound from the supply reservoir to a workstation outlet extending from the pump control, the pump assembly including a high pressure cylinder connected to a valve and quick coupling arrangement in communication with the supply reservoir through the bottom end thereof;

a discharge line extending between the high pressure cylinder and the pump control for feeding joint compound from the supply reservoir to the pump control; and a purge line extending between the pump control and the supply reservoir for priming, recirculating and mixing drywall in the supply reservoir.

2. The workstation of claim 1, wherein the pump assembly includes a piston pump connected to the high pressure cylinder.

3. The workstation of claim 1, wherein the pump control includes a first discharge port for continuously feeding a variety of drywall finishing tools.

4. The workstation of claim 3, wherein the pump control includes a second discharge port for supplying washdown water to clean the tools and act as a source of high pressure fluid.

5. The workstation of claim 1, wherein the high pressure cylinder is connected to the bottom end of the supply reservoir.

6. The workstation of claim 1, wherein the pump assembly is connected to a rear side of the framework.

7. The workstation of claim 1, wherein the workstation outlet includes an on/off valve.

8. The workstation of claim 2, wherein the valve and quick coupling arrangement enables removal of the pump without draining the contents of the supply reservoir.

* * * * *